US012031190B2

(12) United States Patent
Yoshihara et al.

(10) Patent No.: US 12,031,190 B2
(45) Date of Patent: Jul. 9, 2024

(54) METHOD FOR PRODUCING NICKEL-BASED ALLOY PRODUCT OR TITANIUM-BASED ALLOY PRODUCT

(71) Applicant: PROTERIAL, LTD., Tokyo (JP)

(72) Inventors: Mari Yoshihara, Tokyo (JP); Takuya Murai, Tokyo (JP); Tadashi Fukuda, Tokyo (JP); Shoichi Takahashi, Tokyo (JP)

(73) Assignee: PROTERIAL, LTD., Tokyo (JP)

( * ) Notice: Subject to any disclaimer, the term of this patent is extended or adjusted under 35 U.S.C. 154(b) by 0 days.

(21) Appl. No.: 17/776,150

(22) PCT Filed: Nov. 26, 2020

(86) PCT No.: PCT/JP2020/043991
§ 371 (c)(1),
(2) Date: May 11, 2022

(87) PCT Pub. No.: WO2021/106998
PCT Pub. Date: Jun. 3, 2021

(65) Prior Publication Data

US 2022/0389535 A1 Dec. 8, 2022

(30) Foreign Application Priority Data

Nov. 28, 2019 (JP) ..... 2019-215265

(51) Int. Cl.
*C21D 11/00* (2006.01)
*C21D 8/02* (2006.01)
(Continued)

(52) U.S. Cl.
CPC ..... *C21D 11/005* (2013.01); *C21D 8/0226* (2013.01); *C21D 8/0263* (2013.01);
(Continued)

(58) Field of Classification Search
CPC .. C21D 11/005; C21D 8/0226; C21D 8/0263; C21D 1/62; C21D 2261/00; C21D 1/613;
(Continued)

(56) References Cited

U.S. PATENT DOCUMENTS 4,842,652 A 6/1989 Smith et al.
5,419,792 A 5/1995 King et al.
(Continued)

FOREIGN PATENT DOCUMENTS

EP 0284876 A1 10/1988
EP 3290536 A1 3/2018
(Continued)

OTHER PUBLICATIONS

"English language translation of International Search Report", International Application No. PCT/JP2020/043991, Feb. 9, 2021, 2 pp.
(Continued)

*Primary Examiner* — Brian D Walck
*Assistant Examiner* — Nazmun Nahar Shams
(74) *Attorney, Agent, or Firm* — Myers Bigel, P.A.

(57) ABSTRACT

A method for producing a Ni- or Ti-based alloy product includes preliminarily processing a hot working material of a Ni- or Ti-based alloy after hot working into a predetermined shape; heating and holding the material at a solution treatment temperature to obtain a material held in a heated state; and cooling the material to obtain a solution-treated material. The cooling step includes placing a flow path-forming member having a space for forming a flow path for a fluid on a surface of the material held in a heated state to form a fluid flow path defined by the surface of the material held in a heated state and an inner surface of the space of the flow path-forming member; and allowing a fluid to flow in
(Continued)

the fluid flow path so that the fluid in the flow path locally cools a part of the surface of the material.

4 Claims, 5 Drawing Sheets

(51) Int. Cl.
*C22C 14/00* (2006.01)
*C22C 19/03* (2006.01)

(52) U.S. Cl.
CPC ..... *C22C 14/00* (2013.01); *C22C 19/03* (2013.01); *C21D 2261/00* (2013.01)

(58) Field of Classification Search
CPC ..... C22C 14/00; C22C 19/03; C22F 1/002; C22F 1/183; C22F 1/10
See application file for complete search history.

(56) References Cited

U.S. PATENT DOCUMENTS

| | | | |
|---|---|---|---|
| 2003/0098106 | A1 | 5/2003 | Rabinovich et al. |
| 2005/0012250 | A1 | 1/2005 | Rabinovich |
| 2005/0056354 | A1 | 3/2005 | Groh et al. |
| 2007/0113937 | A1 | 5/2007 | Rabinovich |
| 2013/0333190 | A1 | 12/2013 | Mizumura et al. |
| 2017/0081748 | A1 | 3/2017 | Adam et al. |

FOREIGN PATENT DOCUMENTS

| | | | |
|---|---|---|---|
| JP | H10331659 | A | 12/1998 |
| JP | 2000080458 | A | 3/2000 |
| JP | 2003221617 | A | 8/2003 |
| JP | 2005036318 | A | 2/2005 |
| JP | 2017515689 | A | 6/2017 |
| WO | 2012118223 | A1 | 9/2012 |
| WO | 2015136299 | A2 | 9/2015 |

OTHER PUBLICATIONS

"English language translation of International Search Report", International Application No. PCT/JP2020/043993, Feb. 9, 2021, 2 pp.

"Communication with Supplementary European Search Report", EP Application No. 20892781.4, Dec. 12, 2022, 9 pp.

"Communication with Supplementary European Search Report", EP Application No. 20892472.0, Nov. 17, 2022, 10 pp.

METHOD FOR PRODUCING NICKEL-BASED ALLOY PRODUCT OR TITANIUM-BASED ALLOY PRODUCT

RELATED APPLICATIONS

This application is a 35 U.S.C. § 371 national stage application of PCT Application No. PCT/JP2020/043991, filed on Nov. 26, 2020, which claims priority from Japanese Patent Application No. 2019-215265, filed on Nov. 28, 2019, the contents of which are incorporated herein by reference in their entireties. The above-referenced PCT International Application was published in the Japanese language as International Publication No. WO 2021/106998 A1 on Jun. 3, 2021.

TECHNICAL FIELD

The present invention relates to a method for producing a nickel-based alloy product or a titanium-based alloy product.

BACKGROUND ART

When a solution treatment is carried out on a disk-shaped metal material that has been formed into a predetermined shape by hot forging or the like and made of a nickel-based alloy or titanium-based alloy, such as an aircraft engine member, the cooling rate of the entire disk-shaped metal material in the cooling process thereafter is controlled by spraying a gas such as air from a plurality of high-pressure nozzles close to the site where the disk-shaped metal material is to be locally cooled, because of the complex shape of the member, and a freely chosen site of a material held in a heated state is thus rapidly cooled to achieve the desired cooling rate. In addition to air, a liquid refrigerant such as water may be sprayed together with the gas.

REFERENCE DOCUMENT LIST

Patent Document

Patent Document 1: JP 2005-36318 A
Patent Document 2: JP 2003-221617 A

SUMMARY OF THE INVENTION

Problem to be Solved by the Invention

When a gas or a liquid is sprayed from a fixed nozzle toward a disk-shaped metal material in an open space, a flow of the sprayed gas or liquid is generated in the direction moving away from the surface of the disk-shaped metal material, so it is difficult for the gas or liquid to hit the surface of the disk-shaped metal material as the target to be sprayed, and there may be an area where a desired cooling rate is not obtained. For example, if a uniform gas or liquid flow is applied to the entire surface of the disk-shaped metal material, the flow of the gas or liquid to be discharged is inhibited in the radial center part of the disk-shaped metal material, and in essence, a mass of the gas or liquid (an area with a low flow rate) is created, resulting in ineffective cooling.

In addition, since such gases and liquids are mainly sprayed into an open space with a fixed volume between the disk-shaped metal material and pipes or the like, the gases and liquids that reach the disk-shaped metal material surface after spraying have decreasing flow rate at the time of spraying, turning into a flow having a lower flow rate to be discharged, and so may not contribute much to the improvement of the local cooling rate.

An object of the present invention is to provide a method for producing a nickel-based alloy product or a titanium-based alloy product, the method being capable of locally increasing the cooling rate and efficiently utilizing an introduced fluid to perform effective cooling.

Means for Solving the Problem

The present invention has been made in view of the problems described above.

One aspect of the present invention is a method for producing a nickel-based alloy product or a titanium-based alloy product, including: a material preparation step of preliminarily machining a hot working material of a nickel-based alloy or a titanium-based alloy after hot forging or hot ring rolling into a predetermined shape to prepare a material to be subjected to solution treatment; a heating and holding step of heating and holding the material to be subjected to solution treatment at a solution treatment temperature to obtain a material held in a heated state; and a cooling step of cooling the material held in a heated state to obtain a solution-treated material, in which the cooling step includes: placing a flow path-forming member having a space for forming a flow path for a fluid on a surface of the material held in a heated state to form a fluid flow path defined by the surface of the material held in a heated state and an inner surface of the space of the flow path-forming member; and allowing a fluid to flow in the fluid flow path formed between the flow path-forming member and the material held in a heated state so that the fluid in the flow path locally cools a part of the surface of the material held in a heated state.

The flow path-forming member may be configured such that a constricted part in which a cross section of the flow path narrows is formed on the surface of the material held in a heated state to increase a flow rate of the fluid introduced therein.

The flow path-forming member may include a plurality of fluid outlets connecting the flow path inside the flow path-forming member to an outside thereof in positions to be arranged on the material held in a heated state, and the fluid outlet may be configured to have a constricted shape with respect to a cross section of the flow path so as to increase a flow rate of the fluid so that the fluid ejected from the fluid outlets further locally cools at a fluid-ejected part of the surface of the material held in a heated state.

The flow path-forming member may be placed in contact with the surface of the material held in a heated state to form the fluid flow path.

Another aspect of the present invention is a method for producing a nickel-based alloy product or a titanium-based alloy product, including: a material preparation step of preliminarily machining a hot working material of a nickel-based alloy or a titanium-based alloy after hot forging or hot ring rolling into a predetermined shape to prepare a material to be subjected to solution treatment; a heating and holding step of heating and holding the material to be subjected to solution treatment at a solution treatment temperature to obtain a material held in a heated state; and a cooling step of cooling the material held in a heated state to obtain a solution-treated material, in which the cooling step includes: placing a flow path-forming member having a space for forming a flow path for a fluid in contact with a surface of the material held in a heated state to form a fluid flow path defined by the surface of the material held in a heated state and an inner surface of the space of the flow path-forming member, the flow path-forming member being configured such that a constricted part in which a cross section of the flow path narrows is formed on the surface of the material held in a heated state to increase a flow rate of the fluid introduced therein; and allowing a fluid to flow in the fluid flow path formed between the flow path-forming member and the material held in a heated state so that the fluid in the flow path locally cools a part of the surface of the material held in a heated state.

The flow path-forming member may include a plurality of fluid outlets connecting the flow path inside the flow path-forming member to an outside thereof in positions to be contact with the material held in a heated state, and the fluid outlet may be configured to have a constricted shape with respect to a cross section of the flow path so as to increase a flow rate of the fluid so that the fluid ejected from the fluid outlets further locally cools at a fluid-ejected part of the surface of the material held in a heated state.

Effects of the Invention

According to the present invention, the cooling rate can be locally increased to carry out effective cooling even for a material to be treated that has a complex shape, such as a disk-shaped metal material.

MODE FOR CARRYING OUT THE INVENTION

Material Preparation Step

Figure 1:
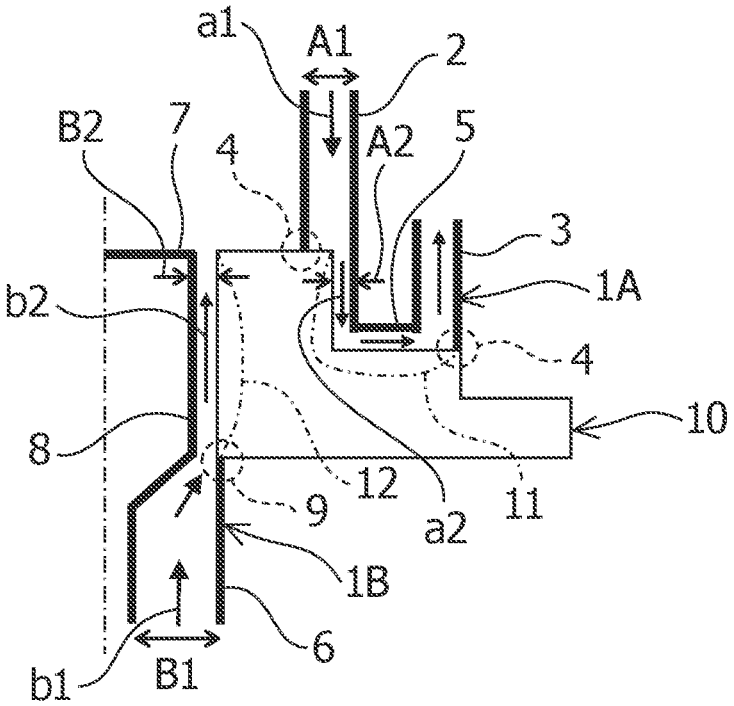
FIG. 1 is a cross-sectional schematic diagram showing an example of a method of cooling a material held in a heated state using a flow path-forming member according to the present invention.

First, in the present invention, a material to be subjected to solution treatment is obtained by machining a hot working material of a nickel-based alloy or a titanium-based alloy after hot forging or hot ring rolling into a predetermined shape in advance.

Typical examples of hot forging include die forging. As used herein, "die forging" is forging that enables forming into a shape close to the final product by upper and lower dies. "Hot forging" includes isothermal forging, in which the forging temperature and the temperature of the metal die are almost the same temperature, and hot die forging, in which the die temperature is set lower than in isothermal forging. In hot ring rolling, the height of a ring-shaped rolling material is pressed while expanding the diameter of the rolling material using a ring rolling mill having at least a main roll, a mandrel roll, and a pair of axial rolls to hot roll a ring-shaped rolling material. The hot working material as the object in the present invention is a material in which thickness changes as viewed on a cross section of the hot working material.

The hot working material formed into a predetermined shape by the hot working is machined into a predetermined shape in advance. The purpose of this machining is, for example, to remove a relatively thick oxidized scale formed during the hot working or modify the contour of the surface of the hot working material by machining such as grinding, cutting, or a blasting treatment, so that when the flow path-forming member and the material held in a heated state, which are described later, are in contact with each other, the contact surfaces are in close contact to suppress unnecessary fluid leakage from the flow path.

In a case of carrying out the solution treatment in an oxidizing atmosphere such as in air, if the roughness of the machined surface is too great, the surface area increases, which may increase the amount of oxidized scale formed during heating and holding at the time of the solution treatment. Therefore, it is desirable that the surface be a surface having a rough finish or finer level in terms of roughness (for example, a surface roughness Ra of 5 to 25 μm), and preferably is a smooth surface having a standard finish or finer level (for example, a surface roughness Ra of 5 to 10 μm).

As used herein, "nickel-based alloy" is an alloy for use in a high temperature region of 600° C. or higher, which is also referred to as a superalloy or heat-resistant superalloy, and is an alloy strengthened by a precipitation phase such as γ'. Typical alloys include 718 alloys and Waspaloy alloys. In addition, 64Ti is an example of a typical titanium-based alloy.

Heating and Holding Step

The material to be subjected to solution treatment, which is obtained by machining the hot working material, is heated and held at a predetermined temperature to obtain a material held in a heated state. The heating temperature and holding time depend on the kind and size of the material, but for example, a temperature range of about 900 to 1200° C. and a time of about 5 to 6 hours are acceptable for a nickel-based alloy. For a titanium-based alloy, a temperature range of about 700 to 1000° C., and a time of about 0.5 to 6 hours are acceptable.

Cooling Step

The material held in a heated state, which is heated and held at the above-described solution treatment temperature, is cooled to obtain a solution-treated material. Since the cooling step is the most characteristic step of the present invention, the cooling step will be described with reference to the drawings. Examples of the fluid used as a refrigerant for cooling the material held in a heated state include gases, liquids, and mixtures of mists and gases. Among these, gases exhibit little volume change even when in contact with a high temperature material held in a heated state, and are refrigerants that are easiest to control the cooling rate. In the following description, a gas is used as the fluid.

Figure 2:
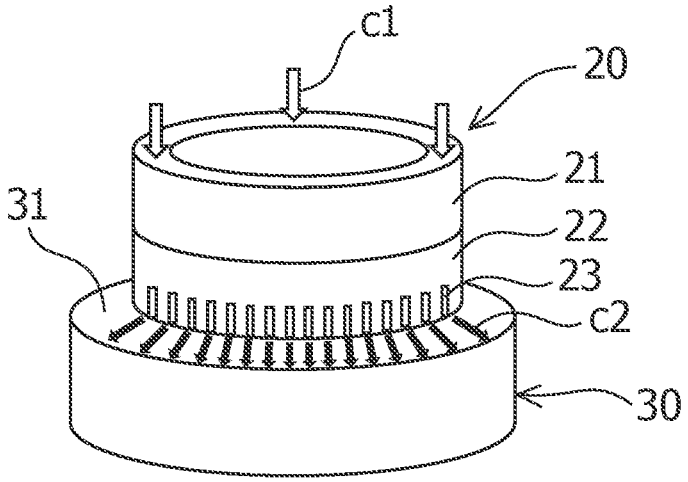
FIG. 2 is a schematic diagram for showing another example of the method of cooling a material held in a heated state using the flow path-forming member according to the present invention.

FIG. 1 is a cross-sectional schematic diagram showing, in a simplified manner, an example of the step of cooling the disk-shaped metal material (material held in a heated state 10) according to the present invention. FIG. 2 is a schematic diagram showing, in a simplified manner, another example of the cooling step according to the present invention.

As shown in FIG. 1, a flow path-forming member 1A having a space is arranged so as to come into contact with the material held in a heated state 10 and cover it to form a gas flow path defined by the inner surface of the flow path-forming member 1A and the surface of the material held in a heated state. The surface of the material held in a heated state 10 is machined so that a contact portion 4, which is indicated by the dashed line, of the material held in a heated state 10 closely contacts the flow path-forming member 1A to suppress leakage of the gas passing therethrough. By contacting the flow path-forming member 1A with the material held in a heated state 10, the flow path that the gas flows along is directly formed on the material held in a heated state 10. That is, a part of the flow path is formed on the surface of the material held in a heated state 10. When the gas flows into the flow path formed between the inner surface of the space of the flow path-forming member 1A and the surface of the material held in a heated state 10, a part of the material held in a heated state 10 which is contacted with the gas flowing along the flow path can be locally cooled. Thus, the flow path-forming member 1A has a preliminarily worked shape so that a flow path can be formed according to the shape of the material held in a heated state 10, and has a structure so that a part of the material to be locally cooled held in a heated state 10 is covered therewith to form a space (i.e., flow path) on the part.

Furthermore, in the present invention, the flow path-forming member 1A is configured such that a constricted part 5 in which the cross section of the flow path narrows is formed on the surface of the material held in a heated state 10 in order to increase the flow rate of a gas to be introduced due to the so-called Venturi effect. The narrowed part 5 corresponds to a part 11 to be preferentially cooled (surrounded by the dash-dot-dash line in FIG. 1) by increasing the flow velocity as the gas passes through the constricted part 5, in which the distance between the flow path forming member 1A and the heat holding material 10 is narrowed. This part 11 is also locally cooled as compared to other parts. This part 11 where local cooling can be preferentially carried out is a part where, during the conventional cooling process in a solution treatment, the flow of the sprayed gas is otherwise inhibited (for example, as shown in FIG. 1, a stepped-shape part having different thicknesses of the material held in a heated state 10). However, according to the present invention, due to the fact that the flow direction of the gas can be constant, and the fact that the flow path for gas is directly formed on the material held in a heated state 10, it is possible to preferentially cool a predetermined part.

The gas may be a single gas or a mixed gas. For example, He gas or a mixed gas thereof may be used for parts where cooling is particularly required, or air may be used for parts where a cooling rate with air is acceptable thereto.

The constricted part 5 shown in FIG. 1 corresponds to the part 11 (surrounded by the dash-dot-dash line in FIG. 1) where cooling can be preferentially carried out. Reference symbol A1 indicates the width of the cross section of the flow path in a gas introduction part 2 of the flow path-forming member 1A, and reference symbol A2 indicates the width of the cross section of the flow path in the constricted part 5. Reference symbol a1 indicates the gas in the gas introduction part 2 and the flow direction thereof, and reference symbol a2 indicates the gas in the constricted part 5 and the flow direction thereof. The width A1 (of the cross section of the flow path) narrowly changes the width A2, and the flow rate of the gas a2 is higher than that of the gas a1. For example, the gas flow rate in the constricted part 5 can be increased up to 50 m/s. The gas that has passed through the constricted part 5 is discharged from a gas discharge member 3 of the flow path-forming member 1A.

Similarly, a constricted part 8 shown in FIG. 1 corresponds to a part 12 of the material held in a heated state 10 where cooling can be preferentially carried out (i.e., an inner circumferential surface of a through hole formed in the material held in a heated state 10 having a ring shape). Reference symbol B1 indicates the width of the cross section of the flow path in a gas introduction part 6 of another flow path-forming member 1B, and reference symbol B2 indicates the width of the cross section of the flow path in the constricted part 8. Reference symbol b1 indicates the gas in the gas introduction part 6 and the flow direction thereof, and reference symbol b2 indicates the gas in the constricted part 8 and the flow direction thereof. The width B1 narrowly changes the width B2, and the flow rate of the gas b2 is higher than that of the gas b1, thereby preferentially carrying out local cooling. The gas that has passed through the constricted part 8 is discharged from a gas discharge member 7 of the flow path-forming member 1B.

A ratio between a cross-sectional area $CA_1$ of the flow path in the gas introduction part 2, 6 of the flow path-forming member 1 and a cross-sectional area $CA_2$ of the constricted part 5, 8 in the gas flow path formed between the surface of the material held in a heated state 10 and the inner surface of the flow path-forming member 1, i.e., $CA_2/CA_1$ (hereinafter, referred to as the "area ratio"), is preferably less than 1.0, more preferably 0.8 or less, and further preferably 0.4 or less. The cross section of the flow path having an area ratio of less than 1 in this way is narrow as described above, and the flow rate of the introduced gas increases due to the so-called Venturi effect, to remarkably exhibiting a local cooling effect. The lower limit of the area ratio is not particularly limited, but for example, the area ratio is preferably 0.05 or more, more preferably 0.10 or more, and further preferably 0.15 or more. Although the widths (also referred to as the "gap distance") A2 and B2 of the cross sections of the flow path in the constricted parts 5 and 8 depend on the shape of the material held in a heated state 10, these widths are each preferably 0.5 mm or more, and more preferably 1.0 mm or more, for example. The upper limit of the gap distances A2 and B2 of the constricted parts 5, 8 is not particularly limited, but the gap distance is preferably 30 mm or less, and more preferably 20 mm or less, for example.

The local cooling in the flow path-forming member 1 may be effective until the temperature of the locally cooled part becomes equal to or less than a certain temperature. This temperature depends on the purpose for controlling the cooling rate of the material held in a heated state by the local cooling. For example, in the case of improving heterogeneity due to the precipitation behavior of the nickel-based alloy and the cooling temperature distribution of the material held in a heated state, the control of the cooling rate by local cooling functions sufficiently if the local cooling is effective until about 700° C. On the other hand, in the case of improving the heterogeneity of a strain distribution due to heat shrinkage during cooling of the material held in a heated state, the local cooling needs to be effective as far as a temperature range below 700° C.

Next, FIG. 2 shows a flow path-forming member that include a plurality of gas outlets 23 in the portion thereof where a flow path-forming member 20 and a material held in a heated state 30 are in contact. In the shown example, the material held in a heated state 30 has a cylindrical shape and the hot forging material product has a flat shape; however, of course the shape of the flow path-forming member 20 may be appropriately changed according to the shape of the material held in a heated state 30.

In FIG. 2, the slit-shaped gas outlets 23 serve as constricted parts in which the end of the flow path-forming member 20 in contact with the material held in a heated state 30 are formed in a constricted shape so that the gas flow rate can be increased, which enables further local cooling of the parts where the gas is ejected from the gas outlets 23. In the structure shown in FIG. 2, the flow path-forming member 20 is an assembly of a shielding portion 22 that includes the gas outlets and an introduction portion 21 connected with the shielding portion 22 as separate portions. The end of the shielding portion 22 including the outlets is in contact with the material held in a heated state 30, and similarly to the structure shown in FIG. 1, a part of the surface 31 of the material held in a heated state 30 forms a part of the flow path. Similarly to FIG. 1, the cross section of the flow path formed between the flow path-forming member 20 and the material held in a heated state 30 narrows as the gas outlet 23, the gas flow rate c2 at the gas outlet 23 is higher than the gas flow rate c1 at the introduction portion 21, thereby carrying out the local cooling described above in this part.

The shielding portion 22 and the introduction portion 21 shown in FIG. 2 each has a "multiple tube" structure having differing diameters and therefore have a gap at fixed interval. The gap between multiple shielding plates (of tube) and the gap between multiple introduction plates (of tube) are used as the gas flow path. The end of the shielding plates and the introduction plates is in contact with a part of the material held in a heated state 30 to be cooled, and the surface of the material held in a heated state 30 forms a part of the gas flow path. In the flow path formed by the gas outlets 23 mentioned above, the gas for rapid cooling flows into the gap between the multiple shielding plates and the gap between the multiple introduction plates, and then turns at the surface of the material held in a heated state 30 to be led out of the material held in a heated state. The flow path has a structure that can receive the back pressure of the gas blown and also has a structure that causes a slight pressure loss at the surface of the material held in a heated state 30 due to slits or the like, thereby making the flow rate distribution in the circumferential direction as uniform as possible. The part of the material held in a heated state 30 to be cooled may optionally be worked in advance into a flat surface, or a shape that facilitates contact with and fixing of the shielding plates and the introduction plates (for example, a recess for fitting the plate structure together).

The structure shown in FIG. 2 is a structure suitable for local cooling around gas outlets 23. Specifically, it is a suitable structure for local cooling of the surface of the material held in a heated state 30 forming the flow path near the gas outlets 23 and the surroundings thereof. The reason the introduction portion 21 and the shielding portion 22 are separate portions is, for example, that when machining the shape of the outlets of the shielding portion 22, it is easier to work into a predetermined shape, and that the constricted state of the flow path can be modified later by adjusting the shape and arrangement position of the shielding portion 22. The gas outlets 23 shown in FIG. 2 have a slit shape, but the shape of the outlets may be another shape, such as a semicircular shape. For local cooling over a wide area, it is preferable to set the interval between the outlets to be formed to a given interval.

Moreover, the flow path-forming member 1 shown in FIG. 1 may be combined with the configuration of the flow path-forming member 20 having the gas outlets 23 shown in FIG. 2.

In the cooling using the flow path-forming member having the structure shown in FIGS. 1 and 2, the cooling rate can be locally increased to carry out effective cooling even for a material to be treated that has a complex shape, such as disk-shaped metal material.

Furthermore, according to the present invention, since leaking gas can be minimized, the cooling efficiency can be increased even at the same flow rate, compared to blowing in an open space. In addition, from the combination of the heat capacity of the flow path-forming member itself with the of continuous cooling effect of the gas on the forming member itself, it can be expected that the flow path-forming member exhibits a cooling effect by physically contacting to the material to be treated to transfer heat, depending on the thickness and shape of the flow path-forming member.

Furthermore, it is not necessary to bring the high-pressure nozzles close to the material held in a heated state, the gas can be supplied to the flow path-forming member by a large introduction pipe, and energy loss due to pressure loss can thus be reduced. In addition, there is no need for a large number of introduction pipes and nozzles as in the prior art, and the structure can be simplified.

In addition, it is also possible to form a structure that enhances the contact cooling effect by providing fins for expanding the heat transfer area in the flow path-forming member.

FIGS. 1 and 2 illustrate embodiments in which a constricted part in which the cross section of the flow path narrows is formed in the gas flow path defined by the surface of the material held in a heated state and the inner surface of the flow path-forming member. However, the present invention is not limited to these embodiments. For example, the constricted part may not be provided, that is, the cross section of the gas flow path defined by the surface of the material held in a heated state and the inner surface of the flow path-forming member may be constant. By configuring in this way, the portion where the flow of the sprayed gas is otherwise inhibited in the cooling process during the conventional solution treatment can be sufficiently effectively cooled by the gas flow path defined by the surface of the material held in a heated state and the inner surface of the flow path-forming member.

Figure 3:
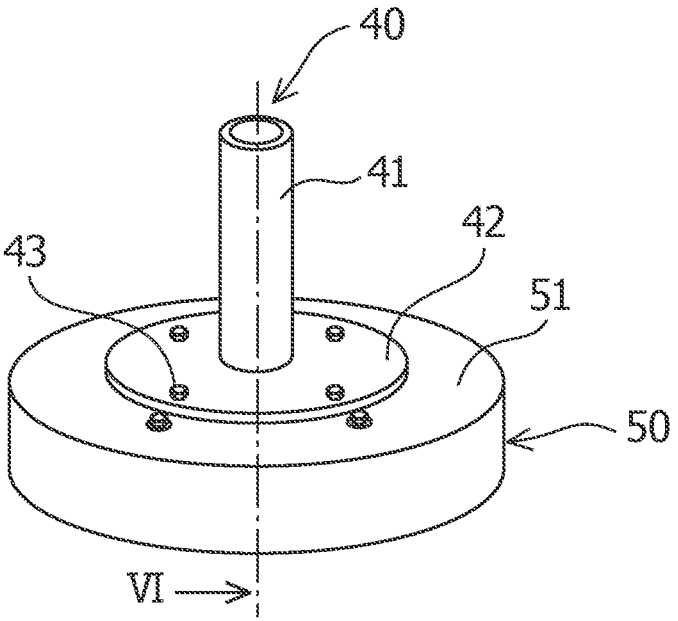
FIG. 3 is a perspective view schematically showing a state in which the flow path-forming member is placed on the material held in a heated state in a cooling test in Examples.
Figure 4:
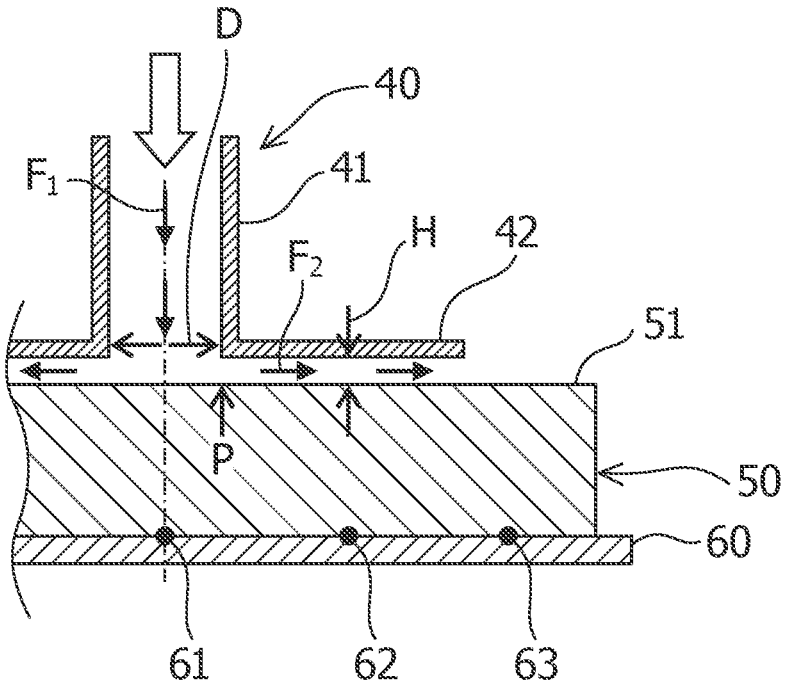
FIG. 4 is a cross-sectional view schematically showing a state in which the flow path-forming member is placed on the material held in a heated state in the cooling test in Examples.

Furthermore, FIGS. 1 and 2 illustrate embodiments in which the gas flow path defined by the surface of the material held in a heated state and the inner surface of the flow path-forming member is formed by arranging the flow path-forming member in contact with the material held in a heated state. However, the present invention is not limited to these embodiments. For example, a gas flow path defined by the surface of the material held in a heated state and the inner surface of the flow path-forming member may be formed without contacting the flow path-forming member with the material held in a heated state as shown in FIGS. 3 and 4, which are described later in detail. By configuring in this way, a predetermined surface of the material held in a heated state can be cooled as in the case in which they are in contact.

EXAMPLES

Hereinafter, examples and comparative examples of the present invention will be described.

First, as the hot working material, a disk-shaped material to be subjected to solution treatment having a diameter of 220 mm and a thickness of 40 mm was obtained from a forged round bar of a nickel-based heat-resistant superalloy (718 alloy) having a diameter of 260 mm by machining involving saw cutting and turning. The surface was finished to a standard finish level with a surface roughness Ra of 6.3 μm. Next, this material to be subjected to solution treatment was heated to a solution treatment temperature of 1120° C. and held at uniform heat for 70 to 100 minutes to obtain a material held in a heated state. Then, a cooling test for obtaining a solution-treated material was carried out by cooling this material held in a heated state using a flow path-forming member 40 shown in FIGS. 3 and 4.

The flow path-forming member 40 included a cylindrical member 41 and a disk member 42 provided at one end of the cylindrical member 41. The cylindrical member 41 was made of carbon steel (S45C) for mechanical structural use, and had a pipe inner diameter D of 20 mm and a length of 100 mm. The disk member 42 was made of carbon steel (SS400) for general structural use, and had a diameter of 150 mm and a thickness of 8 mm. The flow path-forming member 40 was placed on a material held in a heated state 50 so as to form a fluid flow path by the lower surface of the disk member 42 of the flow path-forming member 40 and the surface 51 of the material held in a heated state 50. The lower surface of the disk member 42 of the flow path-forming member 40 and the surface 51 of the material held in a heated state 50 had a structure in which a width H of the flow path, which is the distance between them, was variable using an adjustment screw 43. The material held in a heated state 50 was placed on an insulation material 60.

As for the cooling conditions, the velocity of the gas (compressed air) introduced into the cylindrical member 41 of the flow path-forming member 40 was about 17 m/s (approximate value), and cooling was performed until the temperature of the measurement site was 500° C. or lower. Furthermore, the time taken to convey the material held in a heated state from the completion of the solution treatment to the start of cooling was 24 to 40 seconds. As for the temperature measuring method, thermocouples (K type thermocouples) 61, 62, and 63 were attached to and contacted with the rear surface of the material held in a heated state 50 (also in contact with the insulation material 60). The measurement positions were the center position of the disk-shaped material held in a heated state 50, a position 45 mm from the center, and a position 90 mm from the center. The cooling experiment was performed under three conditions: a width H of the flow path of 2 mm, 4 mm, or 8 mm. The results are shown in Table 1 and FIGS. 5 to 9.

Results in comparative examples are also shown, for a case in which the cooling test was carried out in the same manner as in the examples, except that compressed air was injected from a position 8 mm away onto the surface 51 of the material held in a heated state 50 using a nozzle having an inner diameter of 20 mm instead of the flow path-forming member (Comparative Example 1), and a case in which the cooling test was carried out in the same manner as in the examples, except that the material held in a heated state was left to cool without placing the flow path-forming member or injecting a gas (Comparative Example 2).

TABLE 1

| | Width H of flow path | Area | Time taken from 1000° C. to 700° C. | Time taken from 700° C. to 500° C. | Average cooling rate from 1000° C. to 700° C. [° C./sec] | | | Average cooling rate from 700° C. to 500° C. [° C./sec] | | |
|---|---|---|---|---|---|---|---|---|---|---|
| | [mm] | ratio | [sec] | [sec] | Center | 45 mm | 90 mm | Center | 45 mm | 90 mm |
| Example 1 | 2 | 0.4 | 348 | 340 | 0.87 | 0.86 | 0.80 | 0.60 | 0.59 | 0.52 |
| Example 2 | 4 | 0.8 | 372 | 366 | 0.82 | 0.80 | 0.75 | 0.56 | 0.55 | 0.49 |
| Example 3 | 8 | 1.6 | 400 | 410 | 0.79 | 0.75 | 0.71 | 0.52 | 0.49 | 0.45 |
| Comparative Example 1 | — | — | 464 | 496 | 0.66 | 0.64 | 0.65 | 0.41 | 0.40 | 0.39 |
| Comparative Example 2 | — | — | 652 | 810 | 0.45 | 0.46 | 0.50 | 0.25 | 0.25 | 0.25 |

The "area ratio" in Table 1 is the ratio $CA_2/CA_1$, and specifically, the ratio between the cross-sectional area $CA_1$ of a flow path $F_1$ of the cylindrical member 41 of the flow path-forming member 40 and the cross-sectional area $CA_2$ of a flow path $F_2$ defined by the lower surface of the disk member 42 of the flow path-forming member 40 and the surface 51 of the material held in a heated state 50. The cross-sectional area $CA_2$ is the cross-sectional area at a position P at which the flow path switches from the flow path $F_1$ to the flow path $F_2$ (specifically, a position 10 mm (=D/2) from the center of the flow path-forming member 40). Therefore, the area ratio $CA_2/CA_1$ can be calculated by the following formula. When the area ratio $CA_2/CA_1$ is less than 1, the flow path is constricted at the position P.

$$CA_2/CA_1=(2\pi\times D/2\times H)/\pi(D/2)^2$$

D: Pipe inner diameter of cylindrical member of flow path-forming member

Figure 5:
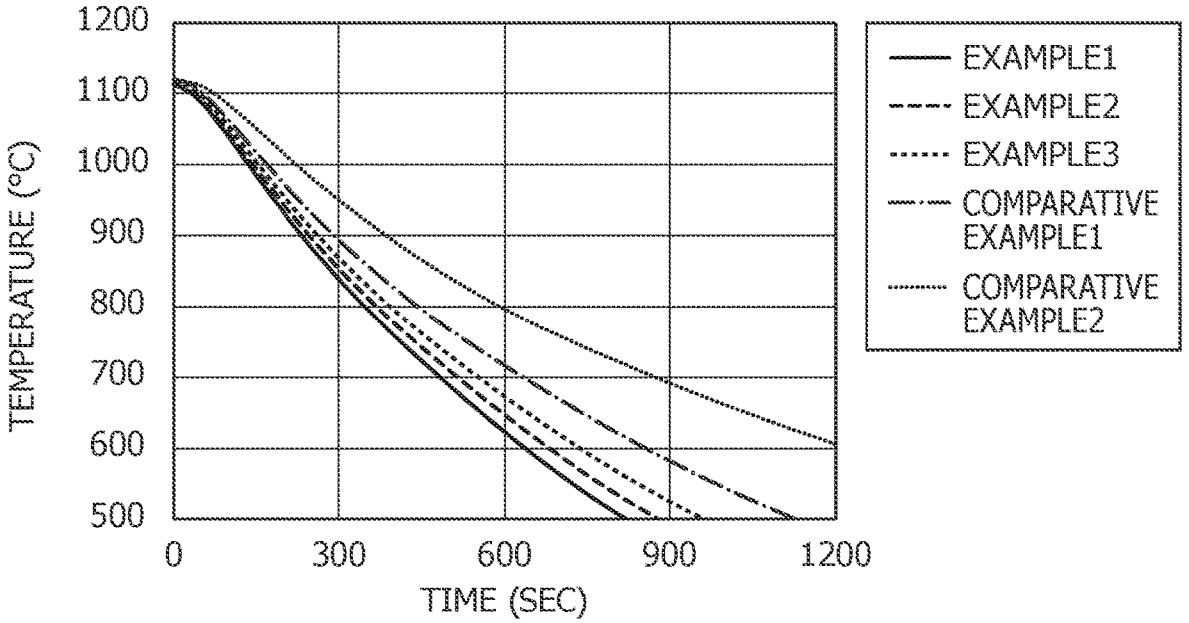
FIG. 5 is a graph showing change in temperature over time at a position 45 mm from the center of the material held in a heated state, in results of the cooling test for Examples and Comparative Examples.

H: Width between the lower surface of the disk of the flow path-forming member and the surface of the material held in a heated state As shown in FIG. 5, in Examples 1 to 3, in which cooling was performed using a flow path-forming member, cooling from 1120° C. to 500° C. at the start of cooling at a position 45 mm from the center of the material held in a heated state was achieved over a time of about 800 to 1000 seconds. On the other hand, in Comparative Example 1, in which cooling was performed using only nozzles, cooling took about 1100 seconds, and in Comparative Example 2, in which the material held in a heated state was left to cool, cooling took about 1600 seconds. From these, it was confirmed that by using a flow path-forming member that forms a flow path with the material held in a heated state, the time taken to cool the portion of the material held in a heated state on which the flow path-forming member is used is shortened compared with the case in which a gas is simply injected from nozzles onto the material held in a heated state.

Figure 6:
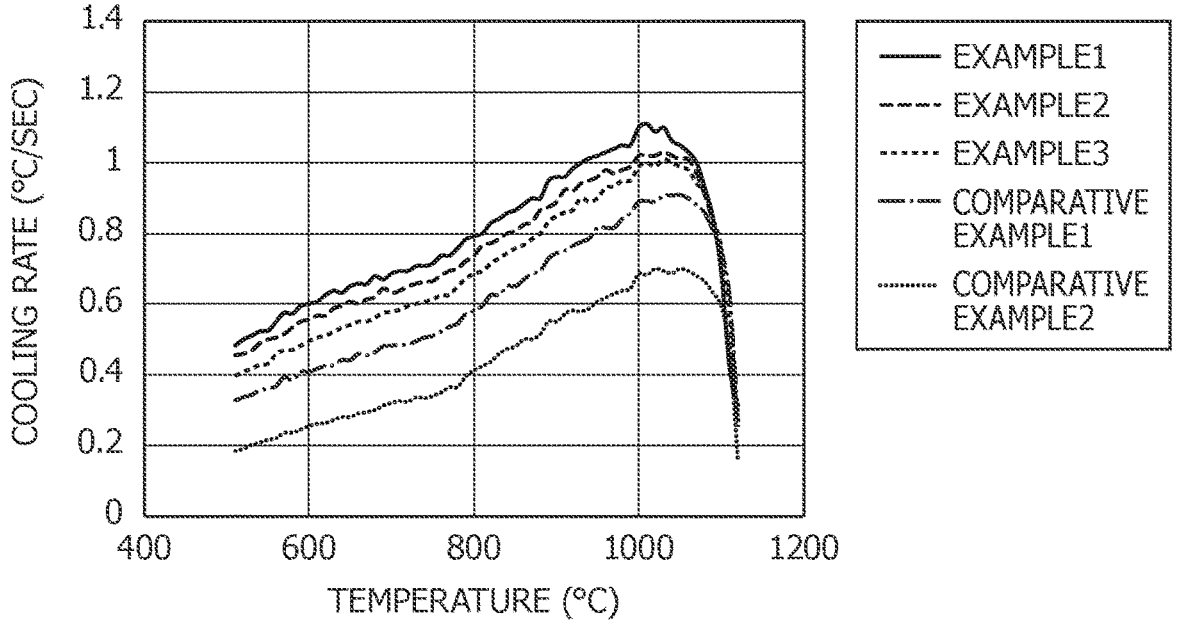
FIG. 6 is a graph showing the change in cooling rate versus time during cooling at a position 45 mm from the center of the material held in a heated state, in results of the cooling test for Examples and Comparative Examples.

As shown in FIG. 6, in Examples 1 to 3, in which cooling was performed using a flow path-forming member, a maximum cooling rate of about 1.0 to 1.1° C./s was observed when the temperature of the material held in a heated state was about 1000° C. at a position 45 mm from the center of the material held in a heated state. On the other hand, in Comparative Example 1, in which cooling was performed using nozzles, the maximum cooling rate was about 0.9° C./s when the temperature of the material held in a heated state was about 1050° C., and in Comparative Example 2, in which the material held in a heated state was left to cool, the maximum cooling rate was about 0.7° C./s when the temperature of the material held in a heated state was about 1050° C. Thus, it was confirmed that using the flow path-forming member enables increase in the cooling rate at the portion of the material held in a heated state on which the flow path-forming member was used. Furthermore, in Examples 1 to 3, although the cooling rate gradually decreased thereafter, a cooling rate of about 0.4° C./s or more was maintained up to about 500° C. On the other hand, the cooling rate gradually decreased also in Comparative Examples 1 and 2, and at about 500° C., the cooling rate decreased to about 0.3° C./s in Comparative Example 1, in which cooling was performed using nozzles, and to about 0.2° C./s in Comparative Example 2, in which the material held in a heated state was left to cool.

As shown in FIG. 6, the cooling rate rapidly increased in the initial stage from 1120° C. to about 1000° C. at the start of cooling, both in Examples and in Comparative Examples. This is presumed to be largely influenced by heat radiation from the material held in a heated state. In the cooling in the range of 1000° C. or less, where the effect of heat radiation is relatively small, the time taken for the temperature of the material held in a heated state to reach 500° C. from 700° C. was longer than that taken to reach 700° C. from 1000° C. in Comparative Example 1, in which cooling was performed using nozzles, and Comparative Example 2, in which the material held in a heated state was left to cool, as shown in Table 1. On the other hand, in Examples 1 to 3, in which cooling was performed using the flow path-forming member, the time taken for the temperature of the material held in a heated state to reach 700° C. from 1000° C. was about the same as that taken to reach 500° C. from 700° C., and the time taken was much shorter than in Comparative Examples 1 and 2 in both temperature ranges. Therefore, it was confirmed that the cooling rate at the portion of the material held in a heated state on which the flow path-forming member was used can be made faster not only in a high temperature region but also in a low temperature region by using the flow path-forming member.

Figure 7:
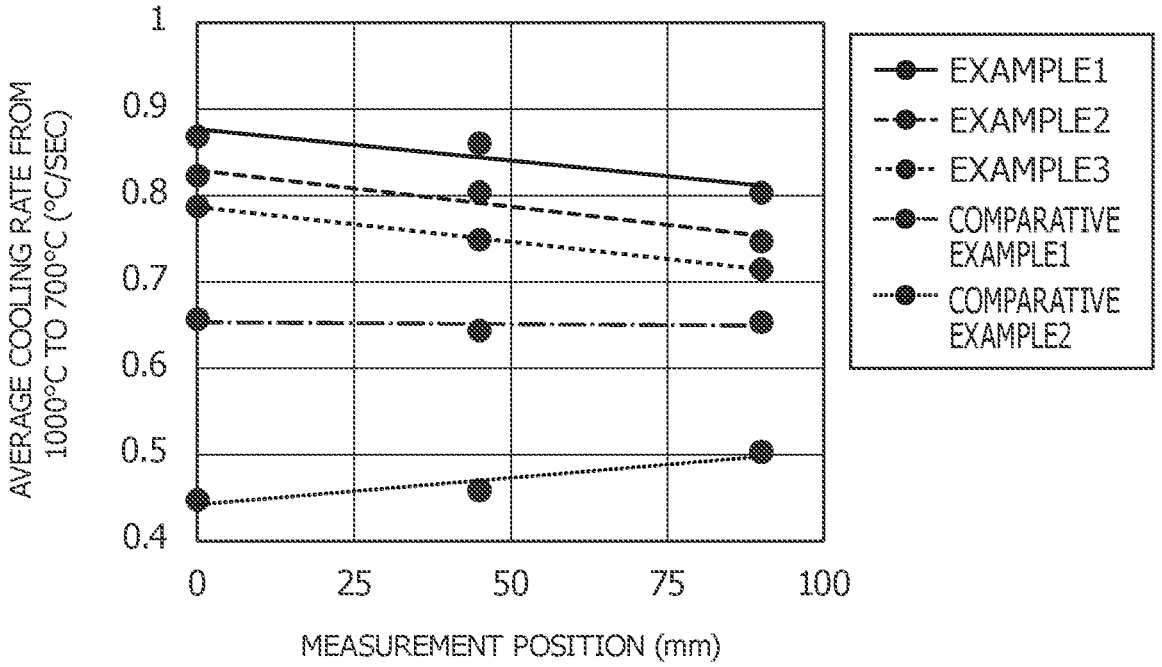
FIG. 7 is a graph showing the average cooling rate from 1100° C. to 700° C. at positions of 0, 45, and 90 mm from the center of the material held in a heated state, in results of the cooling test for Examples and Comparative Examples.

As shown in FIG. 7, in Comparative Example 2, in which the material held in a heated state was left to cool, the average cooling rate from 1100° C. to 700° C. was higher in order of the positions 90, 45, and 0 mm from the center of the material held in a heated state, and so the cooling rate was higher on the outer side of the material held in a heated state. In other words, the center of material held in a heated state had a relatively low cooling rate. On the other hand, in Examples, in which the flow path-forming member was arranged at the center of the material held in a heated state, the average cooling rate from 1100° C. to 700° C. was higher in order of the positions 0, 45, and 90 mm from the center of the material held in a heated state. In Comparative Example 1, in which cooling was performed using nozzles, the average cooling rate was almost the same at all of the positions 0, 45, and 90 mm from the center of the material held in a heated state. Furthermore, as shown in Table 1, the average cooling rate from 700° C. to 500° C. was almost the same in Comparative Examples 1 and 2 at the positions of 0, 45, and 90 mm from the center of the material held in a heated state, whereas in Examples 1 to 3 the average cooling rate was higher in order of 0, 45, and 90 mm from the center of the material held in a heated state. Therefore, it was confirmed that the cooling rate at the portion of the material held in a heated state on which the flow path-forming member is used can be locally increased by using the flow path-forming member.

Figure 8:
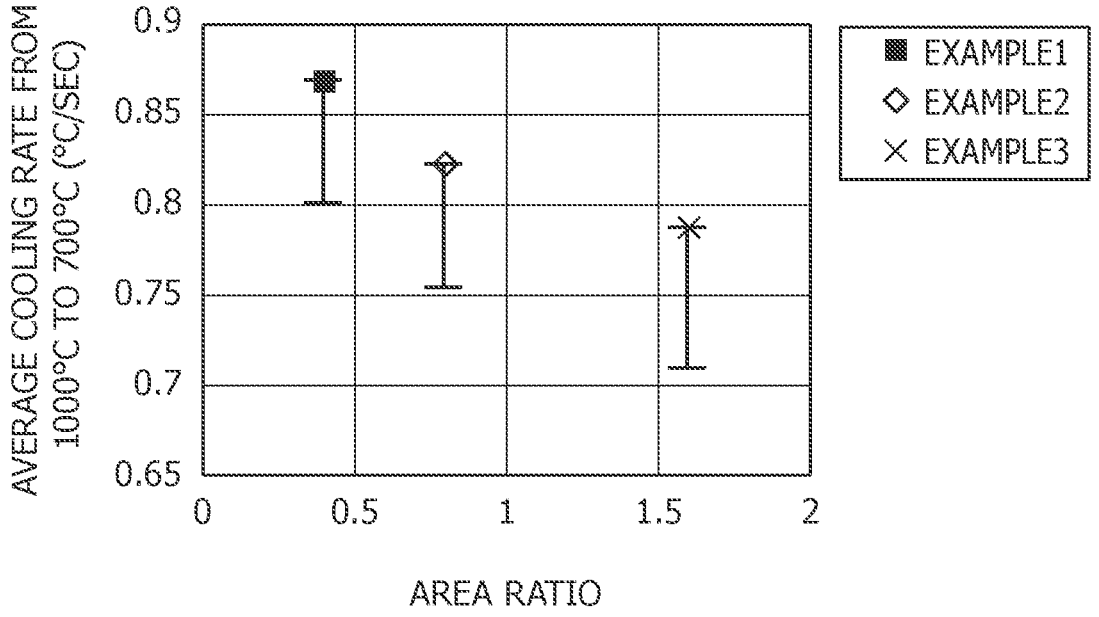
FIG. 8 is a graph showing the average cooling rate from 1000° C. to 700° C. in terms of area ratio at the center of the material held in a heated state, in results of the cooling test for the Examples.

When an effect of providing the constricted part in the flow path is examined, it can be seen that in Examples 1 and 2, in which the area ratio was less than 1, and specifically was 0.4 and 0.8, respectively, the average cooling rate from 1000 to 700° C. at the center position of the material held in a heated state (adjacent to position P, which was the constricted part) was higher than in Example 3, in which the area ratio was 1.6, as shown in Table 1 and FIG. 8. In addition, as shown in Table 1 and FIG. 9, the average cooling rate from 700 to 500° C. at the center position of the material held in a heated state was also higher in Examples 1 and 2, in which the area ratio was less than 1, than in Example 3, in which the area ratio was 1.6. Therefore, it was confirmed that the cooling rate at the portion of the material held in a heated state on which the flow path-forming member was used can be locally increased by using a flow path-forming member which is to form a constricted part in the flow path.

Figure 9:
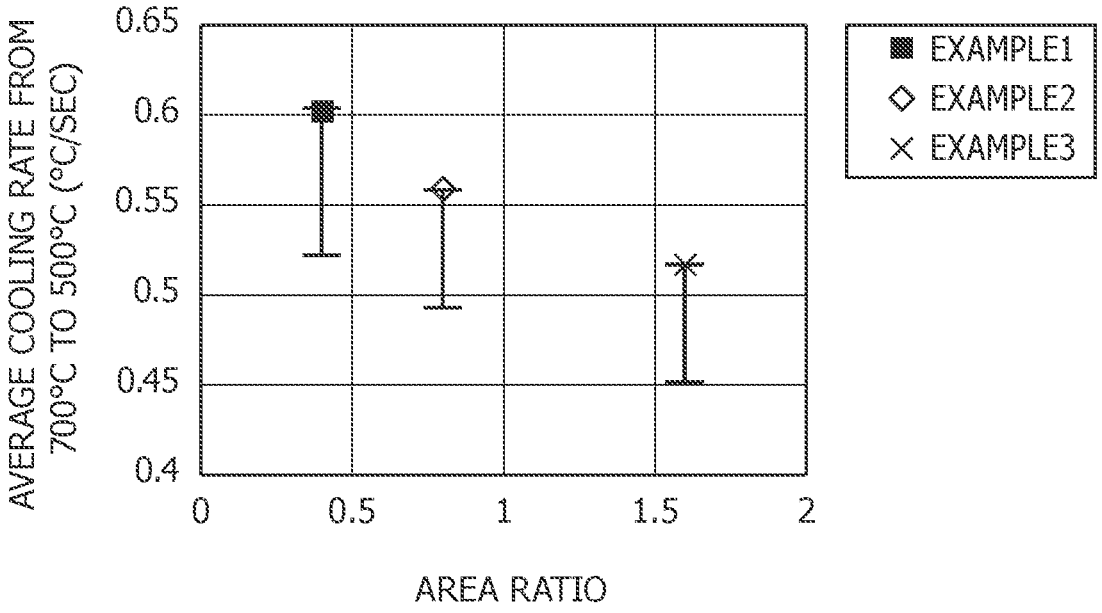
FIG. 9 is a graph showing the average cooling rate from 700° C. to 500° C. in terms of area ratio at the center of the material held in a heated state, in results of the cooling test for the Examples.

FIGS. 8 and 9 are graphs in which the value of the average cooling rate at the center position of the material held in a heated state is plotted with an error bar for the average cooling rate at the positions of 0, 45, and 90 mm from the center of the material held in a heated state. As shown in Table 1 and FIGS. 8 and 9, the average cooling rate in each of Example 1 and Example 2, in which the area ratio was less than 1, was higher than in Example 3, in which the area ratio was 1.6, even at the positions of 45 mm and 90 mm, which were away from the constricted part. It was confirmed from this that the effect of increasing the cooling rate is exhibited not only in the constricted part, but even in the region of the downstream gas from the constricted part.

INDUSTRIAL APPLICABILITY

The cooling using the flow path-forming member according to the present invention can be expected to be applied not only to nickel-based alloys and titanium-based alloys, but to other alloys as well. In addition, mixture of a liquid or a mist with a gas can also be applied as the fluid to be used.

REFERENCE SYMBOL LIST

1: Flow path-forming member
4, 9: Contact portion
5, 8: Constricted part
10: Material held in a heated state
11, 12: Preferential cooling area
20: Flow path-forming member
21: Shielding portion
22: Introduction portion
23: Gas outlet
30: Material held in a heated state
40: Flow path-forming member

50: Material held in a heated state

60: Insulation material

61, 62, 63: Thermocouple

The invention claimed is:

1. A method for producing a nickel-based alloy product or a titanium-based alloy product, comprising:

a material preparation step of preliminarily machining a hot working material of a nickel-based alloy or a titanium-based alloy after hot forging or hot ring rolling into a predetermined shape to prepare a material to be subjected to solution treatment;

a heating and holding step of heating and holding the material to be subjected to solution treatment at a solution treatment temperature to obtain a material held in a heated state; and a cooling step of cooling the material held in a heated state to obtain a solution-treated material, wherein the cooling step comprises placing a flow path-forming member having a space for forming a flow path for a fluid on a part to be locally cooled of a surface of the material held in a heated state so that the flow path-forming member is placed in close contact with the surface of the material held in a heated state to form a fluid flow path defined by the part of the surface of the material held in a heated state and an inner surface of the space of the flow path-forming member so that fluid leakage from the flow path is suppressed; and allowing a fluid to flow in the fluid flow path formed between the flow path-forming member and the material held in a heated state so that the fluid in the flow path locally cools the part of the surface of the material held in a heated state.

2. The method for producing a nickel-based alloy product or a titanium-based alloy product according to claim 1, wherein the flow path-forming member is configured such that a constricted part in which a cross section of the flow path narrows is formed on the surface of the material held in a heated state to increase a flow rate of the fluid introduced therein.

3. The method for producing a nickel-based alloy product or a titanium-based alloy product according to claim 1, wherein the flow path-forming member comprises a plurality of fluid outlets connecting the flow path inside the flow path-forming member to an outside thereof in positions to be arranged on the material held in a heated state, and the fluid outlet is configured to have a constricted shape with respect to a cross section of the flow path so as to increase a flow rate of the fluid so that the fluid ejected from the fluid outlets further locally cools at a fluid-ejected part of the surface of the material held in a heated state.

4. The method for producing a nickel-based alloy product or a titanium-based alloy product according to claim 1, wherein the part of the surface of the material held in a heated state is a stepped-shape part having different thicknesses.

* * * * *